US007812514B2

(12) United States Patent
Kojima et al.

(10) Patent No.: US 7,812,514 B2
(45) Date of Patent: Oct. 12, 2010

(54) IMAGE FORMING APPARATUS AND LIGHT EMITTER SUBSTRATE

(75) Inventors: Shinsuke Kojima, Atsugi (JP); Ginjiro Toyoguchi, Tokyo (JP); Osamu Takamatsu, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 244 days.

(21) Appl. No.: 12/173,982

(22) Filed: Jul. 16, 2008

(65) Prior Publication Data

US 2009/0033203 A1 Feb. 5, 2009

(30) Foreign Application Priority Data

Aug. 1, 2007 (JP) ..... 2007-200936

(51) Int. Cl.
*H01J 1/62* (2006.01)

(52) U.S. Cl. ..... 313/496; 313/495

(58) Field of Classification Search ..... 313/414, 313/441–460, 495–497, 293–304, 306, 309–310, 313/346, 351, 355
See application file for complete search history.

(56) References Cited

U.S. PATENT DOCUMENTS 5,578,899 A * 11/1996 Haven et al. ..... 313/422
6,756,729 B1 * 6/2004 Na et al. ..... 313/496
2008/0012467 A1 * 1/2008 Negishi ..... 313/495

FOREIGN PATENT DOCUMENTS

| | | |
|---|---|---|
| EP | 1 172 836 A1 | 1/2002 |
| JP | 06-338273 | 12/1994 |
| JP | 2002-33058 | 1/2002 |

* cited by examiner

*Primary Examiner*—Nimeshkumar D Patel
*Assistant Examiner*—Donald L Raleigh
(74) *Attorney, Agent, or Firm*—Fitzpatrick, Cella, Harper & Scinto

(57) ABSTRACT

To provide an image forming/displaying apparatus which can achieve high image quality and high reliability, the image forming/displaying apparatus comprises a rear plate having plural electron-emitting devices; and a face plate arranged oppositely to the rear plate. The face plate has plural light emission films for emitting light in response to irradiation of electrons, and black members for mutually separating the plural light emission films from others. The plural light emission films are arranged so that the adjacent light emission films emit light of mutually different colors. Further, a convex member, which projects from the surface of the light emission film, is provided within the area of each light emission film.

6 Claims, 10 Drawing Sheets

IMAGE FORMING APPARATUS AND LIGHT EMITTER SUBSTRATE

BACKGROUND OF THE INVENTION

1. Field of the Invention

The present invention relates to an image forming apparatus and a light emitter substrate.

2. Description of the Related Art

Conventionally, an image forming apparatus which acts as an electron-emitting apparatus using an electron-emitting device has been known. More specifically, as the image forming apparatus like this, for example, a flat type electron displaying panel in which an electron source substrate on which a number of cold cathode electron-emitting devices are formed and an anode substrate which is equipped with a metal back for accelerating the electrons emitted by the electron-emitting devices and or a transparent electrode and a fluorescent body are parallelly opposed to each other has been known. Here, the space between the electron source substrate and the anode substrate has been exhausted and vacuumized. Such an image forming apparatus using a field-emission electron-emitting device {or an FEA (Field Emitter Array) device} is well known.

FIG. 16 is a diagram schematically illustrating the constitution of an electron beam displaying panel as an example of the image forming apparatus using the electron-emitting device. More specifically, in FIG. 16, the electron beam displaying panel includes an electron source substrate 109, a face plate 102 being an anode substrate, a side wall 104, a rear plate 101, and a spacer 103 for defining an interval between the rear plate 101 and the face plate 102, thereby constituting a vacuum envelope. Further, the electron beam displaying panel includes electron-emitting devices 108, row-direction wirings 105 and column-direction wirings 106. The row-direction wirings 105 and the column-direction wirings 106 are respectively connected to device electrodes. Furthermore, the electron beam displaying panel includes a transparent electrode (anode) 116 and a fluorescent body (fluorescent film) 110.

To produce an image in the electron beam displaying panel, a predetermined voltage is first applied sequentially to the row-direction wirings 105 and the column-direction wirings 106 which are arranged like a matrix, thereby selectively driving the predetermined electron-emitting device 108 positioned at the cross point of the matrix. Then, electrons thus emitted are irradiated to the fluorescent body 110, thereby obtaining a light spot. Incidentally, in order to obtain the high-luminance light spot by accelerating the emitted electrons, a high voltage is applied to the transparent electrode 116 through a high voltage terminal Hv to have a high voltage as compared with the electron-emitting device 108. Here, although according to the performance of the fluorescent body, the voltage to be applied is set to several hundreds volt (V) to several tens kilovolt (kV). Accordingly, a distance d between the rear plate 101 and the face plate 102 is generally set to several hundreds micrometer (μm) to several millimeter (mm) so that vacuum dielectric breakdown (that is, electric discharge) due to the applied voltage does not occur.

In the image forming apparatus like this, as illustrated in FIG. 2, the electron beams irradiated to the face plate are back-scattered, and the scattered beams re-enter the face plate due to an electric field. If the back-scattered electrons re-enter the fluorescent body, unnecessary portions of the fluorescent body emit light, thereby occurring a phenomenon called halation. The halation prevents a flat panel image forming apparatus from achieving high contrast and high color purity.

To solve such a conventional problem as described above, each of Japanese Patent Application Laid-Open Nos. H06-338273 and 2002-033058 discloses a proper method. In the relevant method, for example, as illustrated in FIG. 3, a rib (barrier) 14 which is set to have a predetermined height is arranged on a black member 12 on the side of the surface of a face plate 2 opposite to a rear plate. The rib 14 functions to shield the back-scattered electrons so that the back-scattered electrons reach the fluorescent body other than predetermined regions, thereby reducing the halation. In any case, as the rib 14 is higher, an effect of shielding the back-scattered electrons increases.

However, in the above-described conventional display panel, following problems may occur.

As described above, if the rib having the predetermined height is arranged on the black member on the side of the surface of the face plate opposite to the rear plate, the halation can be controlled. However, when aiming to achieve further high contrast and high color purity, it is necessary to further heighten the rib if it intends to sufficiently reduce the halation by the above method.

If the height of the rib increases, an amount of materials to be used to form the rib increases, and thus gas emitted from the rib increases. Consequently, since a degree of vacuum decreases, the fluorescent body, the electron source and the like deteriorate, whereby there is a fear that reliability decreases. Further, since the amount of the used materials increases, costs for manufacturing the apparatus increases resultingly. Furthermore, since it is difficult to form a more higher rib with a high degree of accuracy, it is difficult to obtain a desired shape of the rib.

SUMMARY OF THE INVENTION

The present invention, which has been completed in consideration of such conventional problems as described above, aims to provide an image displaying apparatus or the like which can achieve high image quality and high reliability.

To attain such an object, an image forming apparatus according to the present invention is characterized by comprising: a first substrate which has plural electron-emitting devices; and a second substrate which is arranged oppositely to the first substrate, and has plural light emission members for emitting light in response to irradiation of electrons and black members for mutually separating the plural light emission members from others, and is characterized in that the plural light emission members are arranged so that the adjacent light emission members emit light of mutually different colors, and a convex member, which projects from the surface of the light emission member, is provided within the area of each light emission member.

Further, a light emitter substrate, according to the present invention, which comprises a substrate, plural light emission members, provided on the substrate, for emitting light in response to irradiation of electrons, and black members for mutually separating the plural light emission members from others, is characterized in that the plural light emission members are arranged so that the adjacent light emission members emit light of mutually different colors, and a convex member, which projects from the surface of the light emission member, is provided within the area of each light emission member.

According to the present invention, it is possible to provide the image displaying apparatus which can achieve high image quality and high reliability.

Further features of the present invention will become apparent from the following description of exemplary embodiments with reference to the attached drawings.

DESCRIPTION OF THE EMBODIMENTS

Hereinafter, the exemplary embodiments of the present invention will be described in detail with reference to the attached drawings. Here, it should be noted that the dimensions, the materials, the shapes, the relative configurations and the like described in the embodiments do not limit the scope of the present invention as far as there is no specific description.

An image forming apparatus according to the present invention is the apparatus which forms images by irradiation of electron beams, and contains an FEA (Field Emitter Array) device, an MIM (Metal Insulator Metal) device, a surface-conduction electron-emitter device (SED) or the like as an electron-emitting device. In particular, since the surface-conduction electron-emitter device has a simple constitution and thus can be manufactured easily, a large number of surface-conduction electron-emitter devices can be formed over a wide area. For this reason, the surface-conduction electron-emitter device is a preferable in a case where the present invention is applied.

In the following, it is assumed that the present invention is applied to an image displaying apparatus which is composed of plural light emitters, plural devices for exciting the plural light emitters, and a driving circuit for outputting a driving signal to drive the plural devices. However, since the image displaying apparatus having the plural light emitters, the plural devices and the driving circuit has been well known, the detailed description thereof will be omitted. Namely, the image displaying apparatus will be roughly described.

Figure 1:
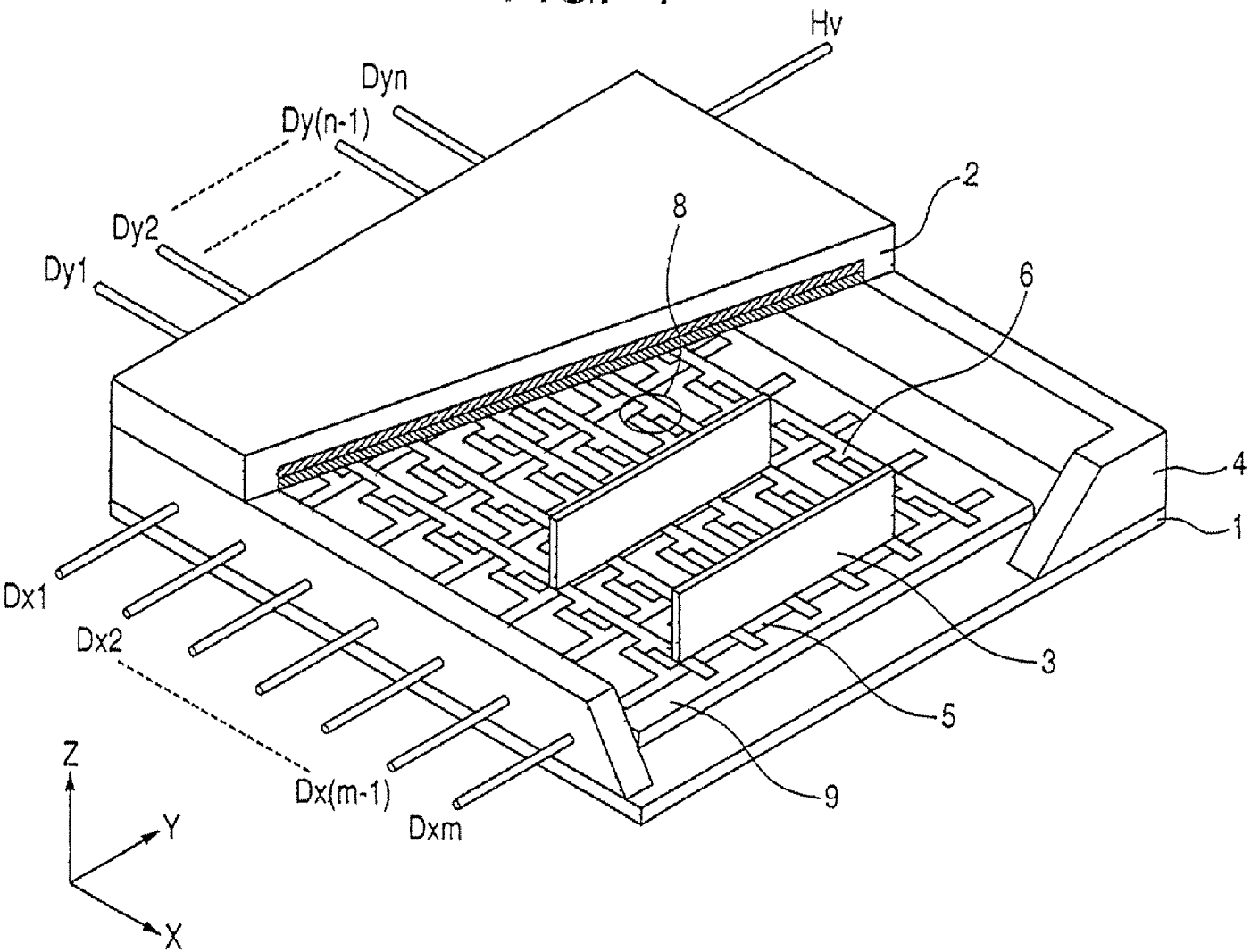
FIG. 1 is a perspective view illustrating a state that a part of a displaying panel according to an embodiment of the present invention is being cut.

FIG. 1 is a perspective view illustrating a state that a part of a displaying panel according to the embodiment of the present invention is being cut.

As illustrated in FIG. 1, the display panel according to the present invention includes a rear plate 1 which acts as a first substrate, a face plate 2 which acts as a second substrate (light emitter substrate) and is opposed to the rear plate 1 by means of a spacer 3, and a side wall 4 which is used to seal the periphery to produce a vacuum atmosphere inside the display panel. Further, row direction wirings 5, column direction wirings 6, an insulation layer (not illustrated) between these wirings, electron-emitting devices 8 are formed on an electron source substrate 9, and the electron source substrate 9 is fixed to the rear plate 1.

The illustrated electron-emitting device 8 is the surface-conduction electron-emitter device (SED) on which a conductive thin film having an electron-emitting portion is connected between device electrodes constituting a pair. In the embodiment, there is provided a multi electron beam source on which the N×M surface-conductive electron-emitter devices are arranged, and the M row direction wirings 5 and the N column direction wirings 6 are respectively matrix-arranged at equal intervals. Further, in the embodiment, scanning signals are applied to the row direction wirings 5 respectively through lead terminals Dx1 to Dxm, and modulation signals (image signals) are applied to the column direction wirings 6 respectively through lead terminals Dy1 to Dyn.

The electrodes of the row direction wirings 5 and the column direction wirings 6 can be formed by applying silver paste in a screen printing method. Further, for example, these electrodes can be formed by using photolithography. In addition to the above silver paste, various kinds of conductive materials can be used as the materials of the electrodes of the row direction wirings 5 and the column direction wirings 6.

Next, the spacer 3 will be described hereinafter. In the image displaying apparatus which uses electron beams as in the present invention, it is necessary in principle to form a vacuum within the image displaying panel. For this reason, since atmospheric pressure is applied to the face plate 2 and the rear plate 1, it is necessary to provide the spacer 3 acting as an interval definition member between the face plate 2 and the rear plate 1. Further, since the spacer 3 is arranged at the position between the face plate 2 and the rear plate 1 to which high voltage is applied, withstand voltage is necessary for the spacer 3. Incidentally, although it is not described in the embodiment, a function film may occasionally be formed on the surface of the spacer 3.

The side wall 4 is arranged at the periphery between the rear plate 1 and the face plate 2, and the joint between the rear plate 1 and the side wall 4 and the joint between the face plate 2 and the side wall 4 are respectively sealed by frit glasses or the like.

The face plate 2 is the anode substrate, and the fluorescent body, the black member, the side wall, the metal back and the like are formed on the surface, opposed to the real plate 1, of the face plate 2. It is needless to say that the substrate of the face plate 2 is transparent. However, the substrate of the face plate 2 preferably has the mechanical intensity and the thermal property which are the same as those of the substrate of the rear plate 1. Further, in case of forming a wide screen display panel, it is preferably possible to use a soda-lime glass, a potassium glass, a glass substrate obtained by laminating $SiO_2$ to the soda-lime glass in liquid phase epitaxy, a sol-gel process, sputtering or the like.

The metal back is provided on the surface of the face plate 2 opposed to the rear plate 1, and a positive high voltage Va is applied from a not-illustrated external power supply to the metal back through a high voltage terminal Hv. Here, it is necessary for the metal back to act as the electrode for applying an acceleration voltage to accelerate the electrons from the electron-emitting device, transmit the accelerated electrons, and act as the reflection film for extracting the light emitted by the fluorescent body to an observer side. Further, it is necessary for the metal back to act as the antistatic device for the fluorescent body. The metal back is characterized by having an extremely thin metal film which is preferably made of aluminum through which the electrons can be easily transmitted. A voltage of 5 kV to 15 kV is applied to the metal back. The metal back may be formed by vacuum vapor deposition after filming already known in the field of CRT.

Since the display panel according to the embodiment performs color display, fluorescent materials of three primary colors (red, green and blue) are divisionally applied to the fluorescent body, and the fluorescent material of each color is applied like, e.g., a stripe. Further, a black member is provided between the adjacent stripes of the different-color fluorescent materials. The objects of providing the black member are to prevent misregistration of the displayed colors by preventing light emission of the adjacent colors even if electron beam irradiation positions are some misregistered, prevent deterioration of display contrast by preventing reflection of outside light, and prevent charging of the fluorescent body due to electron beams. The black member can be formed by a material mainly containing black lead (graphite), but can be formed by another material if it is suitable for the above objects. Further, the fluorescent materials of three primary colors may be respectively applied like, in addition to the stripe, a delta and the like.

The electrons emitted from the electron-emitting device 8 are attracted to the face plate 2, and the attracted electrons are accelerated and irradiated to the fluorescent body. At this time, if the incident electrons have sufficient energy to cause the fluorescent body to emit light, a light spot appears there. Generally, in the fluorescent body which is used in the CRT for a color TV, sufficient luminance and color can be obtained by accelerating and irradiating electrons by an acceleration voltage of several kilovolt (kV) to several tens kilovolt (kV). Since the fluorescent body for the CRT has extremely high performance although it is relatively inexpensive, the fluorescent body of this type is preferably used also in the present invention.

Here, a rib and halation will be described in detail with reference to FIGS. 2, 3, 4 and 5.

Figure 2:
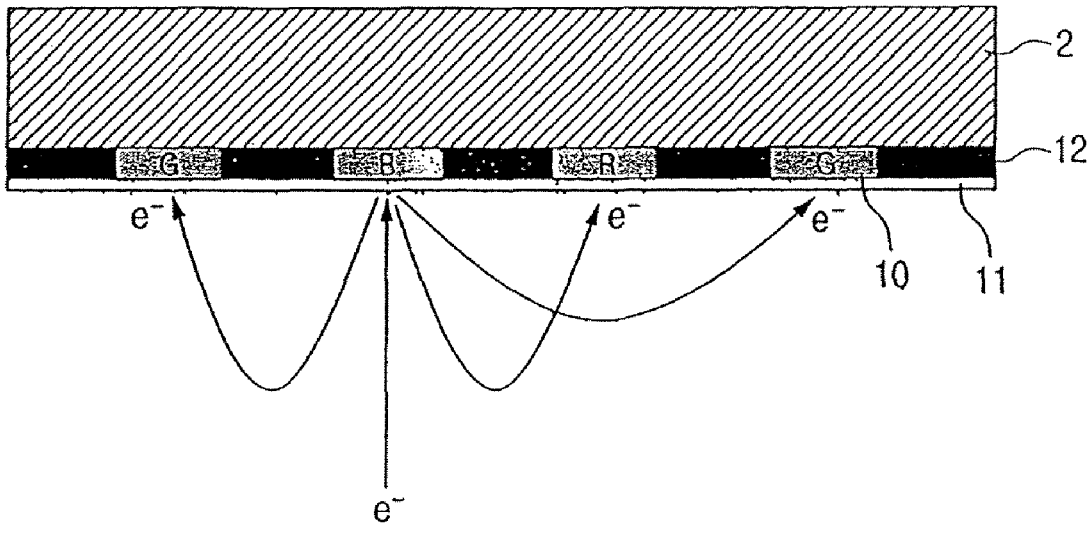
FIG. 2 is a cross sectional view of the face plate portion of an image displaying apparatus, for describing halation.
Figure 3:
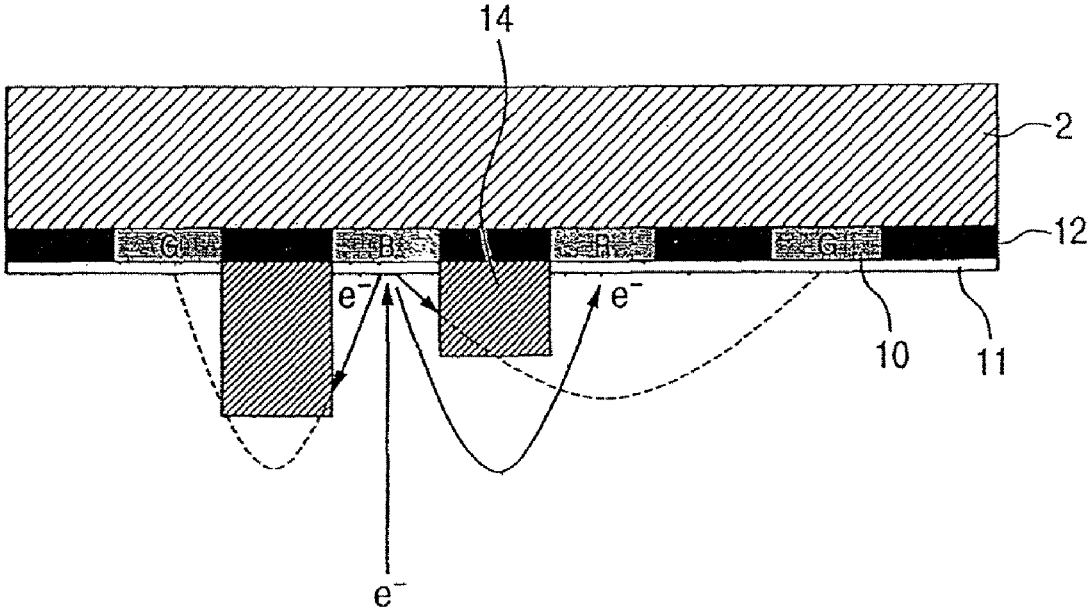
FIG. 3 is a cross sectional view of the face plate portion of the image displaying apparatus, for describing halation.

FIGS. 2 and 3 are cross sectional views of the face plate portion of the image displaying apparatus, for describing the halation.

Plural fluorescent films 10 acting as the light emission members respectively constituted by the fluorescent bodies of three light colors (red (R), green (G), blue (B)) are arranged on the side of the face plate 2 opposed to the rear plate, and black members 12 respectively separating the adjacent fluorescent films 10 are provided between the adjacent films. Further, a metal back 11 is provided on the fluorescent films 10 and the black members 12.

Here, if it is assumed that electron is emitted from an electron-emitting source, the electron emitted from the electron-emitting source is accelerated by high voltage applied to the metal back 11, and the accelerated electron is advanced to the face plate 2. Here, the acceleration voltage to be applied to the metal back 11 is about 5 kV to 15 kV preferably. Since the accelerated electron has high energy, it passes the metal back 11 without serious energy loss. After then, the passed electron is irradiated to the fluorescent body (that is, the fluorescent body of B (blue) in this case).

Here, since a part of the irradiated electrons is reflected with almost energy maintained, back-scattered electrons (also called, reflected electrons, backside-scattered electrons, or elastically scattered electrons) of high energy are produced. The back-scattered electrons advancing toward the rear plate 1 (FIG. 1) are again accelerated by the high voltage applied to the metal back 11, and the accelerated electrons re-enter the face plate 2 substantially along a parabola. Since the back-scattered electrons advance not only toward the incident electron direction but toward various directions, they are also irradiated to sub-pixels other than the selected sub-pixels. Therefore, since the sub-pixels other than the selected sub-pixels (one color in a pixel constituted by three light colors) emit light, deterioration of contrast and color mixture (a phenomenon that color purity deteriorates because light emission occurs in the colors other than the selected color) occur. This is called the halation of back-scattered electrons.

To reduce this halation, it may form the rib for shielding the back-scattered electrons. As illustrated in FIG. 3, a rib 14 is provided on the black member 12 in order to perform shielding so that the back-scattered electrons escape from the selected sub-pixel, and to shield the back-scattered electrons when the relevant back-scattered electrons re-enter.

As illustrated in FIG. 3, according as the height of the rib 14 becomes higher, it becomes possible to shield many back-scattered electrons including even the back-scattered electrons reflected at high angle closer to the vertical, whereby a shielding effect of the back-scattered electrons increases. The shielding effect changes according to a ratio (aspect ratio) between the height and the aperture width of the rib 14 if the interval (aperture width) of the mutually adjacent ribs is constant.

Figure 4:
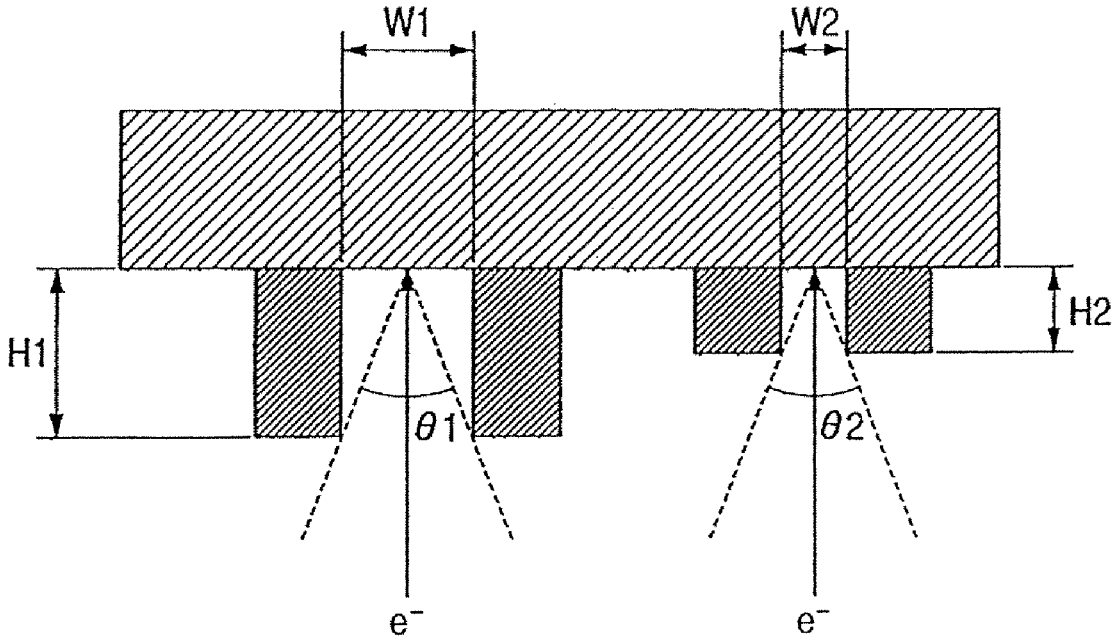
FIG. 4 is a cross sectional view of the face plate portion of the image displaying apparatus, for describing a ratio (aspect ratio) between the height of a rib and the aperture width of the rib.

FIG. 4 is the cross sectional view of the face plate portion of the image displaying apparatus, for describing the ratio (aspect ratio) between the height and the aperture width of the rib.

FIG. 4 indicates two examples of the conformations that one aperture is formed by the two ribs. In one example of FIG. 4, H1 indicates the height of the rib, and W1 indicates the aperture width, whereby the aspect ratio between the rib and the aperture width is obtained as H1/W1. In the other example of FIG. 4, H2 indicates the height of the rib, and W2 indicates the aperture width, whereby the aspect ratio between the rib and the aperture width is obtained as H2/W2. Here, if it is assumed that H1/H2=W1/W2, the aspect ratios of the two examples are the same. At this time, if it is assumed that an angle obtained by the line linking the center of the aperture and the corners of the adjacent ribs constituting the aperture is θ1 in one example and θ2 in the other example, θ1=θ2 is obtained.

As illustrated in FIG. 4, when the electrons irradiated to the aperture are reflected, the electrons reflected at the angle equal to or small than θ1, θ2 are not shielded. Therefore, if the aspect ratios are the same, the effects of shielding the back-scattered electrons are also the same.

Figure 5:
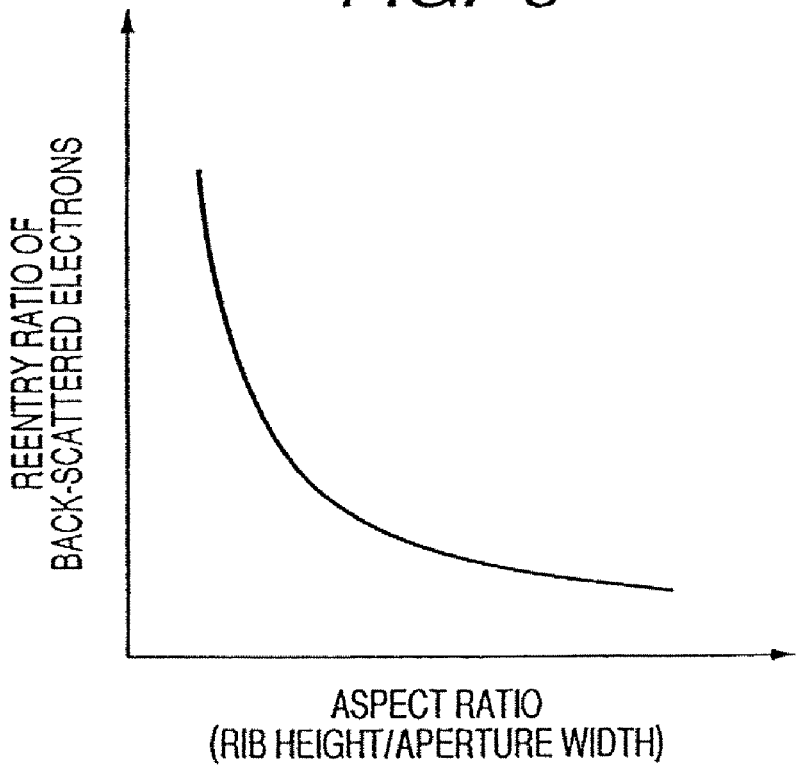
FIG. 5 is a graph indicating the relation between the aspect ratio (horizontal axis) of the height and the aperture width of the rib and a re-entry ratio (vertical axis) of back-scattered electrons into a fluorescent screen.

FIG. 5 is the graph indicating the relation between the aspect ratio (horizontal axis) of the height and the aperture width of the rib and a re-entry ratio (vertical axis) of the back-scattered electrons into a fluorescent screen.

It can be understood from the graph of FIG. 5 that, if the aspect ratio is increased, the re-entry ratio of the back-scattered electrons into the fluorescent screen can significantly be reduced.

As described above, to reduce halation, it may provide the rib on the black member and enlarge the aspect ratio thereof. Therefore, it can be understood that it only has to narrow the aperture width to lower the height of the rib as maintaining the halation reduction effect.

Here, a convex member which is the characterizing portion of the present invention will be described with reference to FIGS. 6 and 7. More specifically, FIG. 6 is the cross sectional view illustrating the image displaying apparatus according to the embodiment of the present invention, and FIG. 7 is the cross sectional view illustrating the face plate portion, for describing reflection of electrons.

Figure 6:
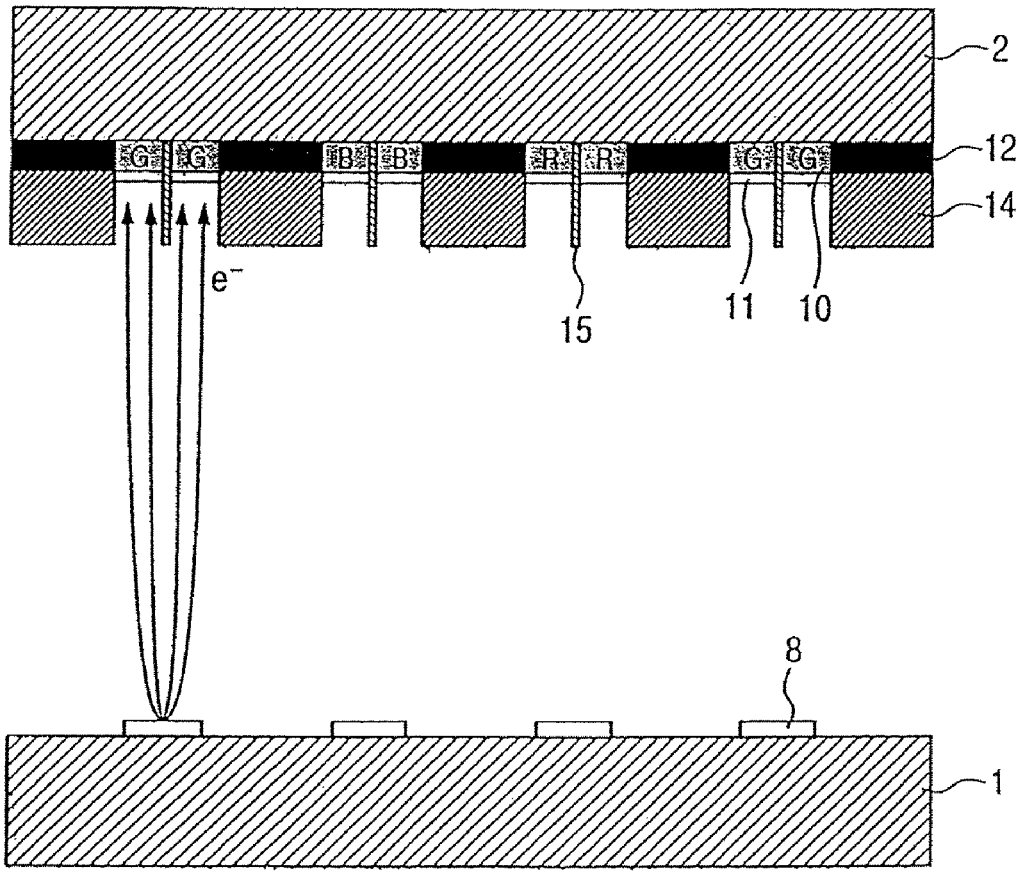
FIG. 6 is a cross sectional view illustrating the image displaying apparatus according to the embodiment of the present invention.

As illustrated in FIG. 6, the rear plate 1 on which the electron-emitting devices 8 are provided is opposed to the face plate 2 at a certain interval. A convex member 15, which is formed in the area of the fluorescent film 10 for each color, functions to shield, as well as the above described rib 14, the back-scattered electrons, thereby reducing halation. Here, the aspect ratio is obtained as the ratio between the width between the rib 14 and the convex member 15 (also including the width between the adjacent convex members 15 if there are the plural convex members 15 in the area of the fluorescent body for each color) and the height from the surface (metal back) of the fluorescent body to the end of the convex member 15. Therefore, as illustrated in FIG. 6, if the thin convex member 15 is arranged at the center between the ribs, the aspect ratio is about twice the aspect ratio in the case where there is no convex member 15, whereby the height of the rib 14 can be made about a half.

To reduce the influence to the electron beams as much as possible, the width of the convex member 15 is made narrow. More specifically, the width of the convex member 15 is made narrower than the width of the rib 14. Further, to obtain the effect of shielding the back-scattered electrons, the height of the convex member 15 from the face plate 2 is made the same as the height of the rib 14 from the face plate 2.

Figure 7:
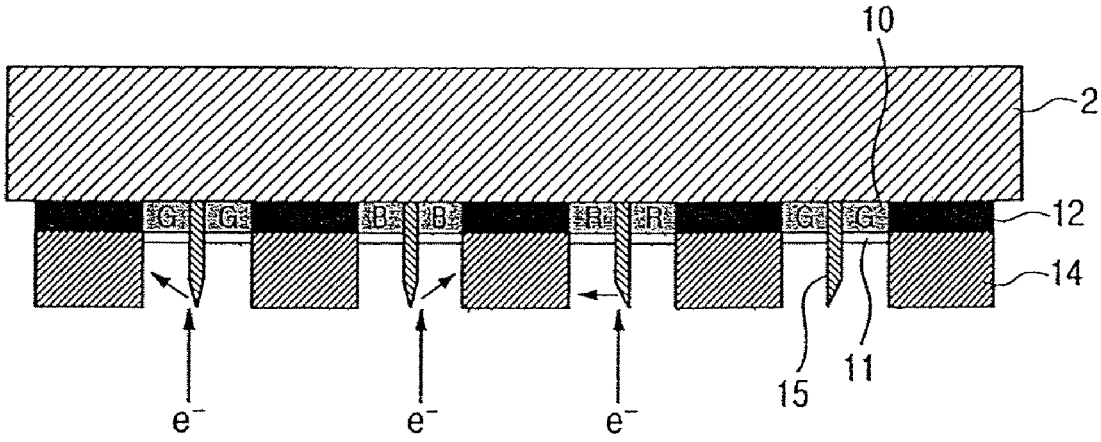
FIG. 7 is a cross sectional view illustrating the face plate portion, for describing reflection of electrons.

Further, as illustrated in FIG. 7, it is preferable to form at least one or more surface, which is inclined in regard to the surface of the rear plate 1 opposed to the convex member 15, at the portion (end portion) of the convex member 15 opposed to the rear plate 1. Consequently, it is possible to prevent that the electrons collided with the end portion of the convex member 15 are reflected toward the rear plate 1.

Incidentally, metals such as Ni, Cu, Ag, Al and the like and dielectric materials such as a low-melting glass frit, a ceramic, polyimide and the like can selectively be used as the materials of the rib 14 and the convex member 15. Here, a method, which is frequently used for a plasma display and the like, of forming the rib 14 and the convex member 15 by using paste containing the ceramic, the low-melting glass frit and the like can be preferably used for the reasons of cost advantages, easiness of manufacturing, and the like. Further, the black material may be included in the material of the rib 14 so that the rib 14 can also function as the black member 12. Furthermore, as the method of manufacturing the rib 14 and the convex member 15, it is possible to use a screen printing method, a photolithography method, a sandblasting method, a mold transfer method by a concave plate, and the like.

As described above, according to the embodiment of the present invention, the convex member 15 is formed in the area of the fluorescent film 10 for each color, and the convex member 15 projects from the surface of the fluorescent film 10. Consequently, since it is possible to lower the heights of the rib 14 and the convex member 15 as reducing halation by shielding the back-scattered electrons. For this reason, since it is possible to reduce an amount of the materials for constituting the rib 14 and the convex member 15, it is possible to suppress by reducing discharged gases from these materials that the fluorescent film 10, the electron source and the like deteriorate. Consequently, it is possible to provide the image forming apparatus which possesses higher reliability and can display high-contrast and high-quality images without color misregistration.

Hereinafter, the present invention will further be described in detail by using several examples.

FIRST EXAMPLE

Figure 8:
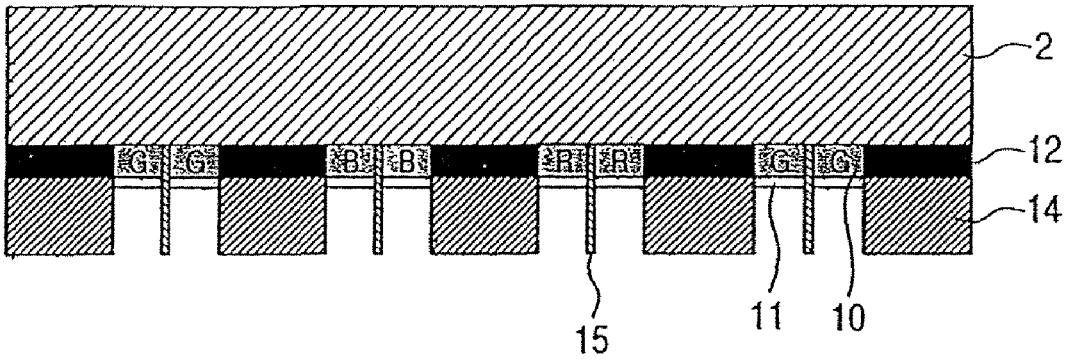
FIG. 8 is a cross sectional view of the face plate of the image displaying apparatus according to a first example of the present invention.
Figure 9:
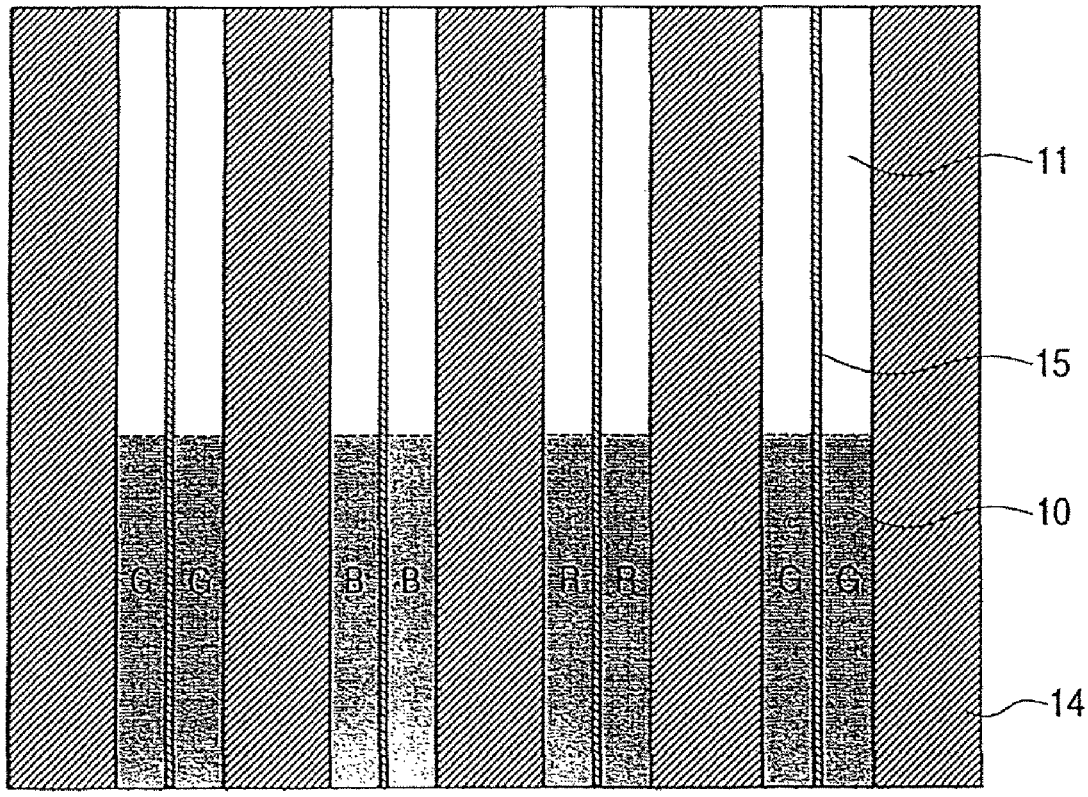
FIG. 9 is a diagram schematically illustrating a state that a metal back on the lower surface of the face plate illustrated in FIG. 8 has been partially removed.

FIG. 8 is a cross sectional view of the face plate of the image displaying apparatus according to the first example of the present invention. FIG. 9 is a diagram schematically illustrating a state that the metal back on the lower surface of the face plate illustrated in FIG. 8 has been partially removed.

Hereinafter, the first example of the present invention will be described with reference to FIGS. 8 and 9.

On the face plate 2 used for the image displaying apparatus of the present example, each of the plural fluorescent films 10 is provided like a stripe between the black members 12. Each of the fluorescent films 10 is composed by any one of the fluorescent bodies of three colors (red (R), green (G), blue (B)), and the fluorescent films 10 are repetitively arranged in order of R, G, and B. Therefore, the plural fluorescent films 10 are arranged so that the adjacent fluorescent films 10 respectively emit light of mutually different colors. The convex member 15, which is provided at the center of the area of the fluorescent film 10 of each color, extends along the length direction of the fluorescent film 10.

With respect to the fluorescent film 10 of each color, the width between the black member 12 and the convex member 15 is 70 μm, and the height (Z direction in FIG. 1) is 15 μm. The width and the height of the black member 12 are 50 μm and 15 μm respectively, and the rib 14 is provided on the black member 12. Further, the width of the rib 14 is 50 μm as well as the black member 12, but the height thereof is 100 μm. The width and the height of the convex member 15 which is the characterizing portion of the present invention are 10 μm and 115 μm respectively, and the metal back 11 is provided on the fluorescent film 10. Here, an aluminum thin film having the thickness 100 nm is used as the metal back 11.

Subsequently, the rear plate 1 which is used in the present example will be described with reference to FIG. 1. That is, the plural surface-conduction electron-emitter devices (electron-emitting devices 8) are arranged on the rear plate 1, the pitches of the electron-emitting devices are respectively 200 μm in the column direction and 600 μm in the row direction, and the respective electron-emitting devices are arranged so as to be opposed to the respective fluorescent films on the face plate 2. Further, the row direction wirings 5 and the column direction wirings 6 which electrically connect the respective electron-emitting devices are formed by silver paste consisting of silver and low-melting glass. Incidentally, the descriptions of the detailed constitutions and the manufacturing methods for the electron-emitting devices and the rear plate will be omitted.

Subsequently, the spacer 3 to be used in the present example will be described with reference to FIG. 1. The spacer 3, which is composed of a glass substrate, is formed to have the thickness 200 μm and the height 1.8 mm by a heat drawing method. Further, the length of the spacer 3 is made longer than the image area (namely, the image displaying area in which the electron-emitting devices and the fluorescent films are arranged). The spacer 3 is in contact with both the scanning wirings of the rear plate 1 and the ribs of the face plate 2 so as to define the interval 1.8 mm. Incidentally, the description of the manufacturing method for the spacer 3 will be omitted.

Subsequently, the manufacturing method of the face plate to be used in the present example will be described with reference to FIGS. 10A, 10B, 10C and 10D.

(Process 1) Initially, the face plate 2 which is composed of a low alkali glass substrate of which the thickness is 1.8 mm is washed.

Figure 10A:
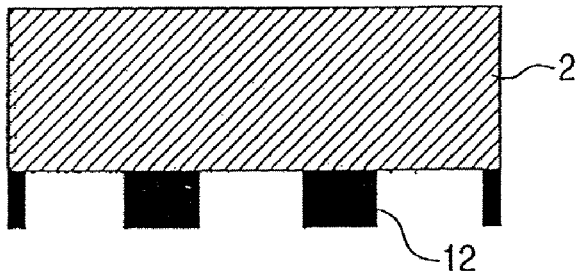
FIGS. 10A, 10B, 10C and 10D are diagrams for describing a manufacturing method of the face plate used in the first example of the present invention.

(Process 2) The black member 12 of which the thickness (corresponding to the above-described height, i.e., the Z direction in FIG. 1) is 15 μm is applied on the face plate 2 by a slit coater to expose, develop and bake a desired pattern, thereby forming the black member 12 having the above-described shape (FIG. 10A).

Figure 10B:
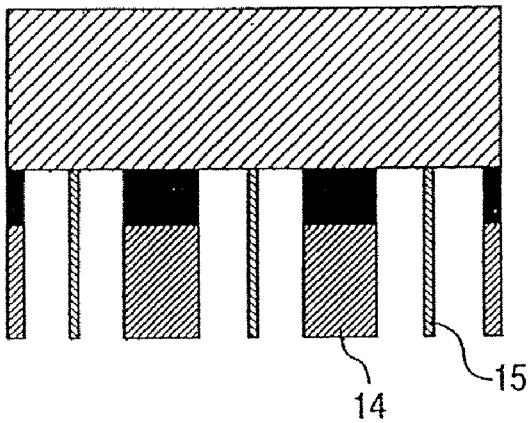

(Process 3) Subsequently, the paste of the materials of the rib 14 and the convex member 15, of which the thicknesses from the glass surface (corresponding to the above-described heights, i.e., the Z direction in FIG. 1) are 115 μm (the height from the black member is 100 μm) is applied by the slit coater. Here, paste containing alumina and low-melting glass frit is used as the paste of the materials of the rib 14 and the convex member 15. Next, a dry film resist (DFR) is laminated on the applied members, and the laminated DFT is exposed and developed, thereby forming a mask for sandblasting. Then, unnecessary portions of the rib 14 and the convex member 15 are eliminated by the sandblasting method. Next, the DFR is peeled off, the substrate is washed, and the washed substrate is baked, thereby forming the rib 14 and the convex member 15 respectively having the above-described shapes (FIG. 10B).

Figure 10C:
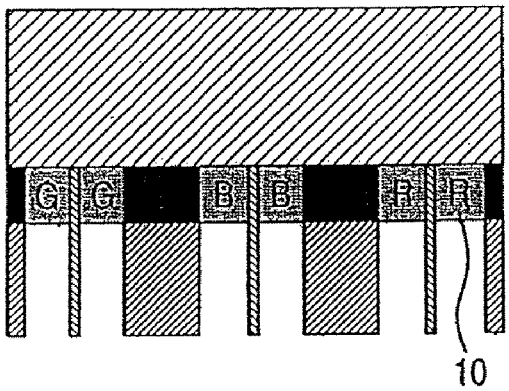

(Process 4) Subsequently, a fluorescent material is applied to the aperture portion formed by the ribs 14, the convex member 15 and the black members 12. More specifically, the fluorescent materials of R, G, B three colors are separately applied respectively with a desired thickness by the screen printing method. Here, a P22 fluorescent material is used as the relevant fluorescent material. After then, the applied fluorescent material is baked, and thus the fluorescent film 10 having the above-described shape is formed (FIG. 10C).

Figure 10D:
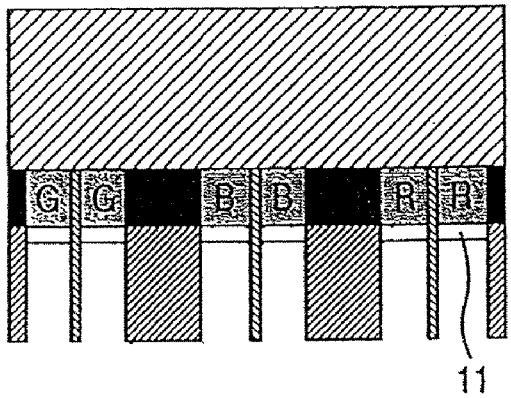

(Process 5) Subsequently, the metal back 11 is formed by a filming method which has been already known in the field of CRT. That is, an acrylic emulsion adhesive is first applied on the fluorescent film 10 by a spray method, and then the obtained film is dried. Then, aluminum is formed by vacuum vapor deposition, and the formed aluminum is baked in the atmosphere to eliminate organic constituents therefrom. Thus, the metal back 11 having the above-described shape is formed (FIG. 10D).

The rear plate 1 and the face plate 2, which were formed as described above, are arranged and sealed to be opposed to each other via the side wall 4, thereby forming the image displaying apparatus as illustrated in FIG. 1. Then, if a voltage of 10 kV is applied to the metal back 11 through the high voltage terminal Hv to drive the image displaying apparatus, excellent image display in which halation was been reduced could be achieved.

SECOND EXAMPLE

Subsequently, the second example of the present invention will be described with reference to FIG. 11. The second example is different from the first example in the point that the end surface of the convex member 15 is inclined in regard to the surface of the rear plate 1 opposed to the convex member 15. Since other points of the second example are the same as those in the first example, the description thereof will be omitted.

Figure 11:
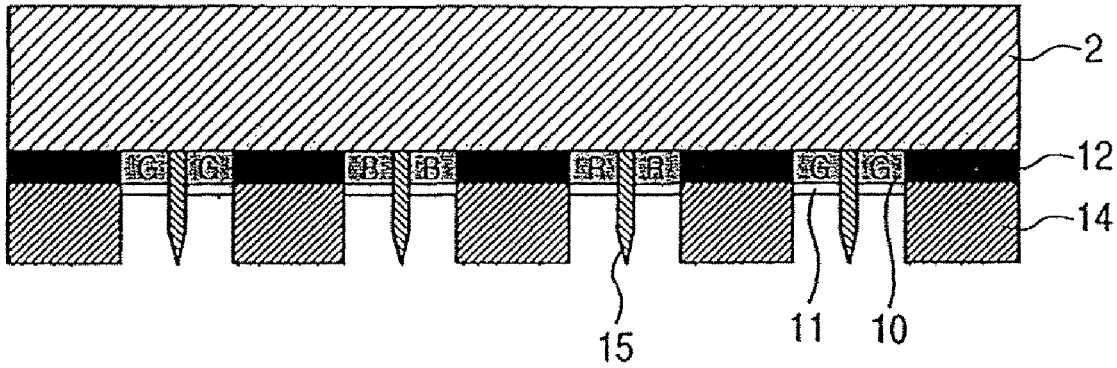
FIG. 11 is a cross sectional view of the face plate of the image displaying apparatus according to a second example of the present invention.

FIG. 11 is the cross sectional view of the face plate of the image displaying apparatus according to the second example of the present invention. In the image displaying apparatus according to the present example, the end of the convex member 15 is manufactured to be inclined in regard to the surface of the opposed rear plate 1. More specifically, as well as the first example, unnecessary portions of the convex member 15 are eliminated by the sandblasting method, the DFR is peeled off, the obtained substrate is washed, and then the corner of the convex member 15 is eliminated again by the sandblasting method. Thus, it is possible to prevent that the electrons collided with the end of the convex member 15 are reflected toward the rear plate 1.

As well as the first example, a high contrast and high color purity image in which halation has been reduced can be displayed by the image forming apparatus in the present example.

THIRD EXAMPLE

Subsequently, the third example of the present invention will be described with reference to FIGS. 12 and 13. The third example is different from the first and second examples in the point that the black members 12 are formed like lattices (not stripes), and in the point that the plural convex members 15 are provided on each fluorescent film 10. The reason why the black members 12 are not arranged like stripes but are arranged like lattices is to improve a bright-environmental contrast. Since other points of the third example are substantially the same as those in the first example, the description thereof will be omitted.

Figure 12:
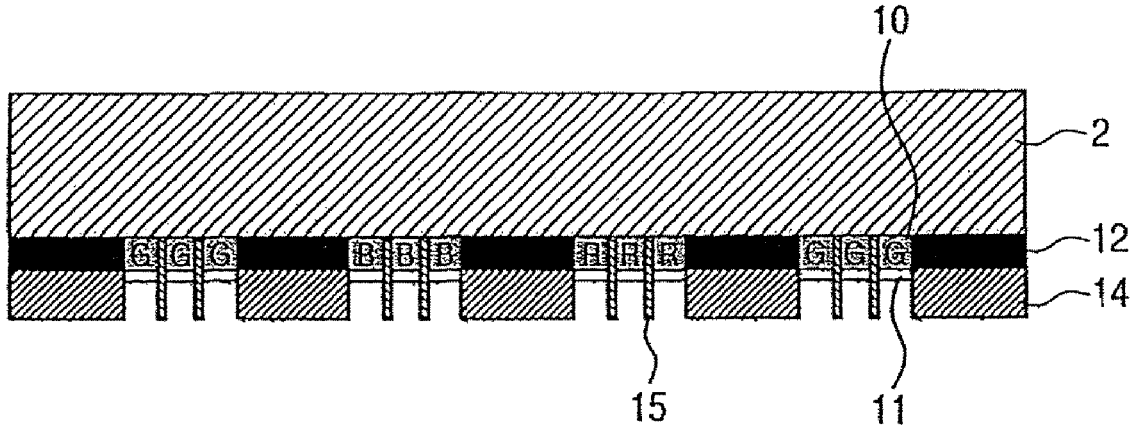
FIG. 12 is a cross sectional view of the face plate of the image displaying apparatus according to a third example of the present invention.
Figure 13:
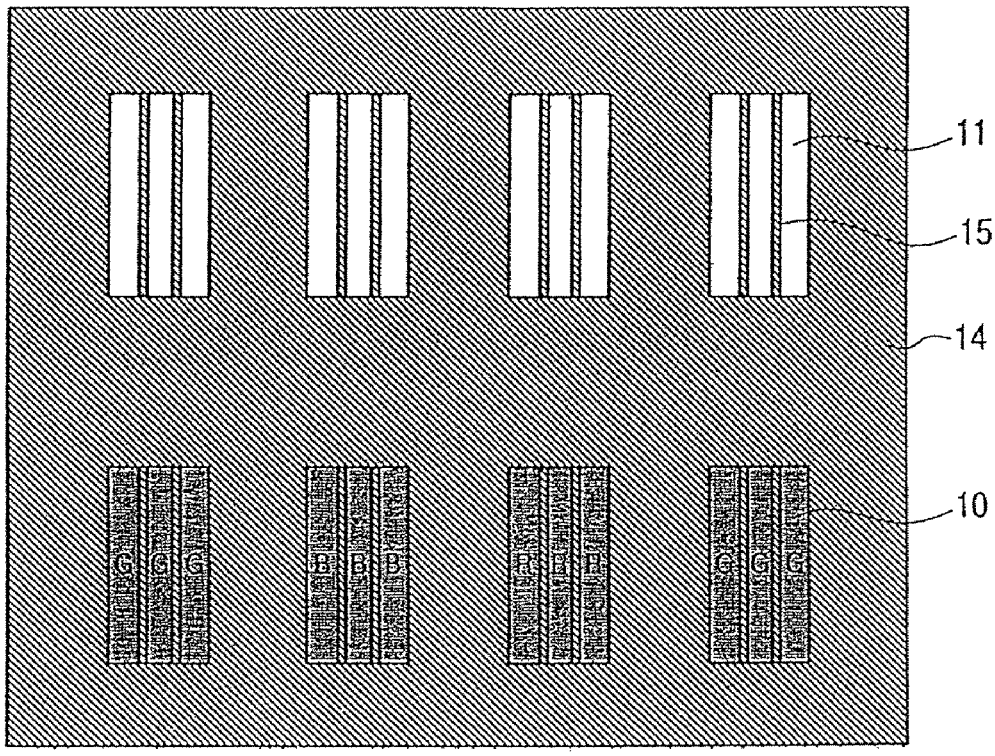
FIG. 13 is a diagram schematically illustrating a state that a metal back on the lower surface of the face plate illustrated in FIG. 12 has been partially removed.

FIG. 12 is the cross sectional view of the face plate of the image displaying apparatus according to the third example of the present invention. FIG. 13 is the diagram schematically illustrating a state that the metal back on the lower surface of the face plate illustrated in FIG. 12 has been partially removed.

In the image displaying apparatus of the present example, the fluorescent film 10 of each color is positioned between the black member 12 and the convex member 15 and between the adjacent convex members 15, and the width, the length and the height (corresponding to the above-described height, i.e., the Z direction in FIG. 1) of the fluorescent film 10 are 43 μm, 300 μm and 15 μm, respectively. Further, the width, the length and the thickness (corresponding to the above-described height, i.e., the Z direction in FIG. 1) of the black member 12 are 50 μm, 300 μm and 15 μm, respectively. The fluorescent films 10 of three colors and the black members 12 form a square pixel of 600 μm×600 μm, and the rib 14 is provided on the black member 12. The width and the height of the rib 14 are, as well the black member 12, 50 μm and 60 μm respectively. The two convex members 15, which are the characterizing portion of the present invention, are provided within the area of each fluorescent film 10 so as to equally divide the fluorescent film 10 into three. Further, the width, the length and the height of the convex member 15 is 10 μm, 300 μm and 75 μm respectively.

The same effect as that in the first example can be obtained even in the image displaying apparatus according to the present example. Further, in the image displaying apparatus according to the present example, excellent image display in which color purity is higher (color mixture is lower) as compared with the first example can be achieved.

FOURTH EXAMPLE

Subsequently, the fourth example of the present invention will be described with reference to FIGS. 14 and 15. The fourth example is different from the first to third examples in the point that the convex members 15, instead of the black members 12, are formed like lattices all over the face plate 2 and arranged on the black members 12 and the fluorescent films 10. Since other points of the fourth example are substantially the same as those in the third example, the description thereof will be omitted.

Figure 14:
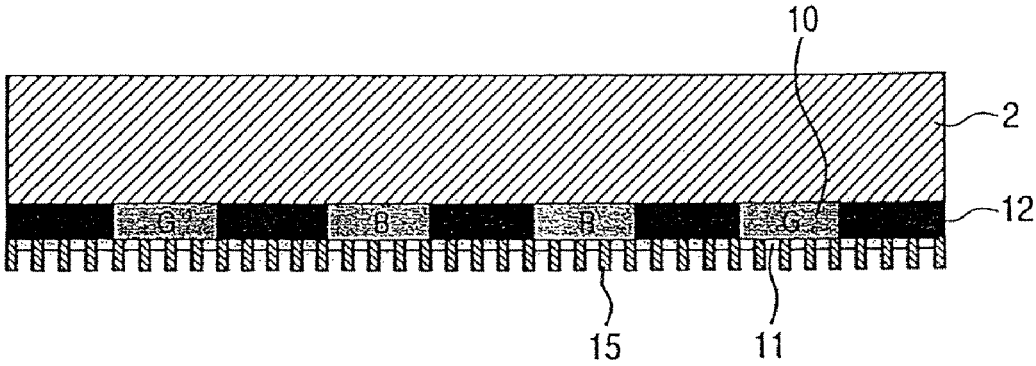
FIG. 14 is a cross sectional view of the face plate of the image displaying apparatus according to a fourth example of the present invention.
Figure 15:
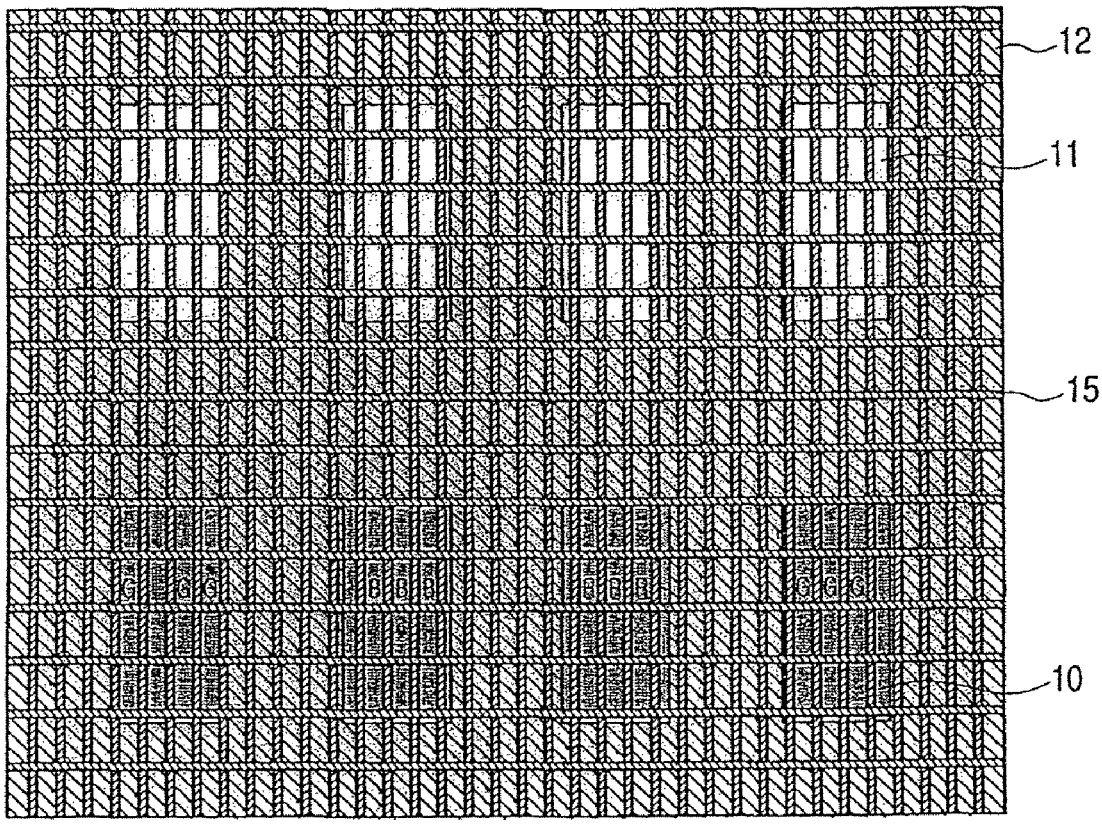
FIG. 15 is a diagram schematically illustrating a state that a metal back on the lower surface of the face plate illustrated in FIG. 14 has been partially removed.
Figure 16:
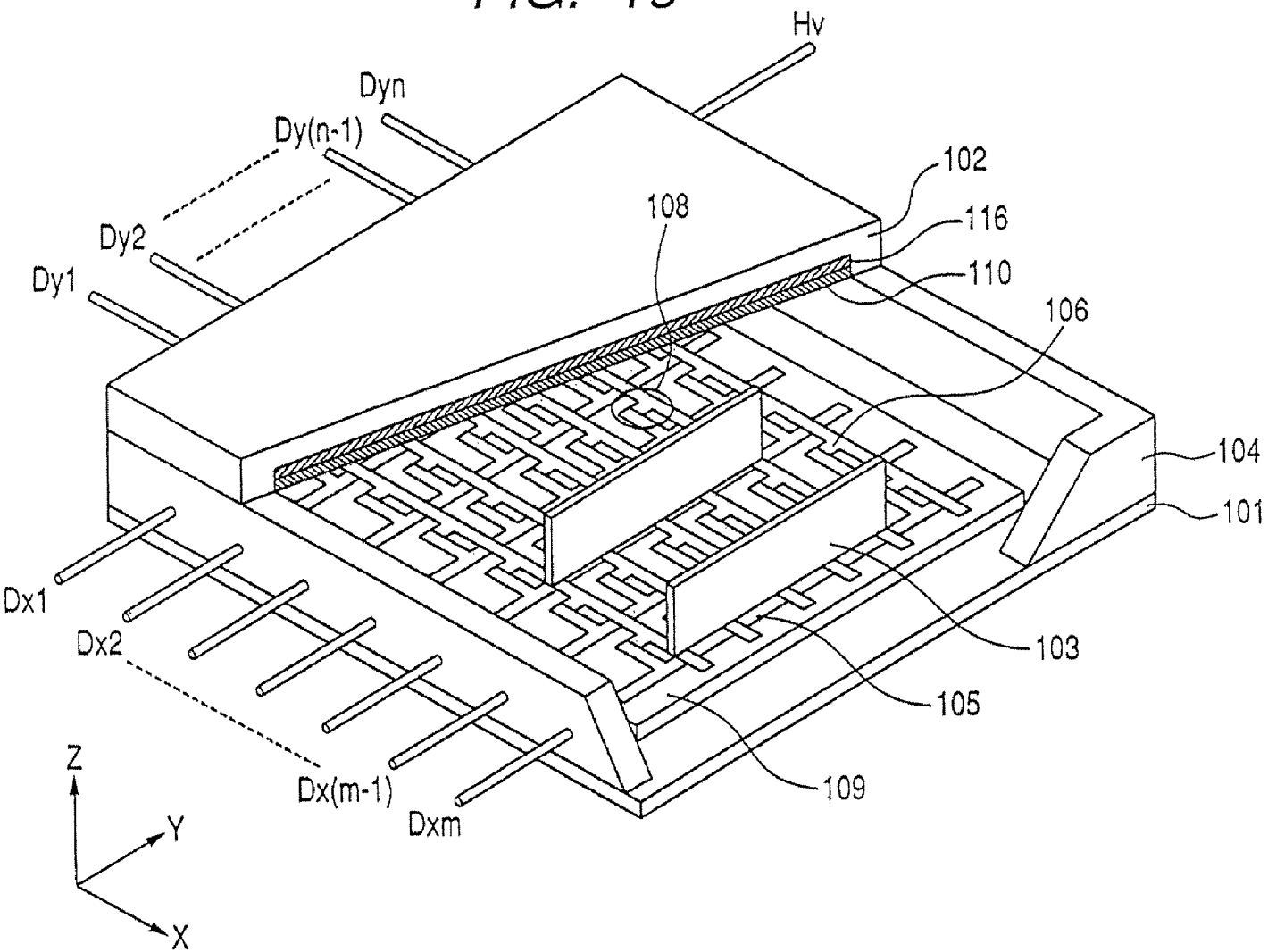
FIG. 16 is a perspective view illustrating an electron beam displaying panel as one example of an image forming apparatus which utilizes an electron-emitting device.

FIG. 14 is the cross sectional view of the face plate of the image displaying apparatus according to the fourth example of the present invention. FIG. 15 is the diagram schematically illustrating a state that the metal back on the lower surface of the face plate illustrated in FIG. 14 has been partially removed.

In the image displaying apparatus of the present example, the width, the length and the thickness (corresponding to the above-described height, i.e., the Z direction in FIG. 1) of the fluorescent film 10 between the black members 12 are 150 μm, 300 μm and 15 μm, respectively. Further, the width, the length and the thickness (corresponding to the above-described height, i.e., the Z direction in FIG. 1) of the black member 12 are 50 μm, 300 μm and 15 μm, respectively. The fluorescent films 10 of three colors and the black members 12 form a square pixel of 600 μm×600 μm. Further, the convex members 15, which are the characterizing portion of the present invention, are formed like lattices all over the face plate 2, and the width and the height of each of the convex members 15 is 5 μm and 35 μm respectively. Furthermore, the width and the length (that is, the size) of the aperture surrounded by the convex members 15 are 25 μm and 70 μm respectively.

In the present example, the convex members 15 are manufactured by patterning a resist film with use of X-ray, injecting slurry ceramics into the obtained pattern grooves, and then baking the whole.

The same effect as that in the first example can be obtained even in the image displaying apparatus according to the present example. Further, in the image displaying apparatus according to the present example, excellent image display in which color purity is higher (color mixture is lower) as compared with the first example can be achieved.

While the present invention has been described with reference to exemplary embodiments, it is to be understood that the invention is not limited to the disclosed exemplary embodiments The scope of the following claims is to be accorded the broadest interpretation so as to encompass all such modifications and equivalent structures and functions.

This application claims the benefit of Japanese Patent Application No. 2007-200936, filed Aug. 1, 2007, which is hereby incorporated by reference herein in its entirety.

What is claimed is:

1. An image forming apparatus, comprising:

a first substrate which has plural electron-emitting devices; and a second substrate which is arranged oppositely to the first substrate, and has plural light emission members for emitting light in response to irradiation of electrons and black members for mutually separating the plural light emission members from others, wherein the plural light emission members are arranged so that the adjacent light emission members emit light of mutually different colors, a convex member, which projects from the surface of the light emission member, is provided within the area of each light emission member, wherein a rib is formed on the black member, and wherein the width of the convex member is narrower than the width of the rib.

2. An image forming apparatus according to claim 1, wherein plural convex members are provided within the area of each light emission member.

3. An image forming apparatus according to claim 1, wherein a portion of the convex member opposite to the first substrate has at least one surface inclined in regard to a surface of the first substrate opposite to the convex member.

4. An image forming apparatus comprising:

a first substrate which has plural electron-emitting devices; and a second substrate which is arranged oppositely to the first substrate, and has plural light emission members for emitting light in response to irradiation of electrons and black members for mutually separating the plural light emission members from others, wherein the plural light emission members are arranged so that the adjacent light emission members emit light of mutually different colors, a convex member, which projects from the surface of the light emission member, is provided within the area of each light emission member, wherein a rib is formed on the black member, and wherein the height of the convex member from the second substrate is the same as the height of the rib from the second substrate.

5. A light emitter substrate which comprises a substrate, plural light emission members, provided on the substrate, for emitting light in response to irradiation of electrons, and black members for mutually separating the plural light emission members from others, wherein the plural light emission members are arranged so that the adjacent light emission members emit light of mutually different colors, and a convex member, which projects from the surface of the light emission member, is provided within the area of each light emission member, wherein a rib is formed on the black member, and wherein the width of the convex member is narrower than the width of the rib.

6. A light emitter substrate which comprises a first substrate, plural light emission members, provided on the first substrate, for emitting light in response to irradiation of electrons, and black members for mutually separating the plural light emission members from others, wherein the plural light emission members are arranged so that the adjacent light emission members emit light of mutually different colors, and a convex member, which projects from the surface of at least one light emission member, is provided within the area of each light emission member, wherein a rib is formed on at least one black member, and wherein the height of the convex member from a second substrate, which is arranged oppositely to the first substrate, is the same as the height of the rib from the second substrate.

* * * * *